US005181969A

United States Patent [19]

Komatsubara et al.

[11] Patent Number: 5,181,969

[45] Date of Patent: Jan. 26, 1993

[54] ROLLED ALUMINUM ALLOY ADAPTED FOR SUPERPLASTIC FORMING AND METHOD FOR MAKING

[75] Inventors: Toshio Komatsubara; Tsutomu Tagata; Mamoru Matsuo, all of Tokyo, Japan

[73] Assignee: Sky Aluminum Co., Ltd., Tokyo, Japan

[21] Appl. No.: 711,308

[22] Filed: Jun. 6, 1991

[30] Foreign Application Priority Data

Jun. 11, 1990 [JP] Japan ..... 2-152283
Mar. 28, 1991 [JP] Japan ..... 3-89893

[51] Int. Cl.[5] ..... B22D 25/00; C22C 21/06

[52] U.S. Cl. ..... 148/552; 148/440; 420/542; 420/543; 420/545; 420/902

[58] Field of Search ..... 148/2, 11.5 A, 440; 420/542, 543, 545, 552, 553, 902; 204/29, 58

[56] References Cited

U.S. PATENT DOCUMENTS 4,531,977 7/1985 Mishima et al. ..... 148/2
4,645,543 2/1987 Watanabe et al. ..... 148/2

FOREIGN PATENT DOCUMENTS 57-002858 1/1982 Japan ..... 420/543

*Primary Examiner*—R. Dean
*Assistant Examiner*—Robert R. Koehler
*Attorney, Agent, or Firm*—Oliff & Berridge

[57] ABSTRACT

Provided is a superplastic forming aluminum alloy in rolled form which exhibits superplasticity and has improved corrosion resistance, weldability, and strength and fatigue property after superplastic forming, eliminating a need for heat treatment after superplastic forming. Preferred alloys have an excellent outer appearance of grey to black color after anodization. The alloy consists essentially of, in % by weight, 2.0–8.0% of Mg, 0.3–1.5% of Mn, 0.0001–0.01% of Be, an optional element selected from C, V, and Zr, an optional grain refining agent of Ti or Ti and B, less than 0.2% of Fe and less than 0.1% of Si as impurities, and the balance of Al, wherein intermetallic compounds have a size of up to 20 μm, and the content of hydrogen present is up to 0.35 cc/100 grams. Particularly when a minor amount of Ti or Ti and B grain refining agent is contained, Mn precipitates have a size of 0.05 μm or larger, and the Si content in entire precipitates is less than 0.07% of the total rolled alloy weight, the rolled alloy is grey or black on the anodized surface.

12 Claims, 2 Drawing Sheets

ROLLED ALUMINUM ALLOY ADAPTED FOR SUPERPLASTIC FORMING AND METHOD FOR MAKING

This invention relates to a rolled aluminum alloy adapted for superplastic forming and a method for preparing the same.

BACKGROUND OF THE INVENTION

A variety of superplastic materials were developed in recent years. When stretched at appropriate strain rates at elevated temperatures, superplastic materials show significant elongation without local distortion or necking.

As to aluminum alloys, research works were concentrated on superplastic aluminum alloys having an elongation of at least 150% at elevated temperatures of 350° C or higher. Conventional aluminum base superplastic materials include Al.78% Zn alloy, Al.33% Cu alloy, Al.6% Cu.0.4% Zr alloy (Supral), Al-Zn-Mg-Cu alloys (7475 and 7075 alloys according to the AA standard), and Al.2.5.6.0% Mg.0.05.0.6% Zr alloys. Such superplastic materials can be readily formed into complex shapes.

A number of attempts have been made to apply superplastic materials in a variety of uses by taking advantage of their improved forming ability at elevated temperatures.

In general, corrosion resistance considerations are essential in order that aluminum alloy materials be useful as interior and exterior building panels, containers, and cases (e.g., trunks). In this respect, aluminum alloy materials are most often subject to coating or anodizing prior to use. In the case of coating, aluminum alloy materials should have firm adhesion to coating films and good corrosion resistance after coating. In the latter case, aluminum alloy materials have to be prone to anodization and to become fully corrosion resistant after anodization. They are also required to be free of streaks or other irregular patterns after anodization in view of the outer appearance. For use as structural members, not only strength, fatigue resistance, and toughness after mechanical forming are required, but also improved adhesion and weldability are required since they are often attached to other members by adhesive bonding or welding. For use as interior and exterior building panels and cases (e.g., trunks), anodized aluminum alloy materials are desired to exhibit a placid grey or black color.

Conventional superplastic forming aluminum alloys contained a substantial amount of copper and similar alloying elements since superplastic behavior was of the main concern. As a consequence, they suffered from many problems.

(A) They were less corrosion resistant without anodization.

(B) They were less amenable to anodization in that desmutting was poor and powdering occurred on the surface.

(C) They were less corrosion resistant even after anodization.

(D) After anodization, they often show streaks and other irregular patterns, and poor appearance therewith.

(E) Adhesion and weldability are poor.

(F) For coating application, it is rather difficult to pretreat the underlying surface for coating reception and thus the corrosion resistance after coating is low.

(G) Cavitation often occurs with losses of strength, fatigue resistance and toughness.

The conventional superplastic forming aluminum alloys were improved in forming, but had many drawbacks including poor corrosion resistance as mentioned above. These drawbacks prevented the alloys from finding practical commercial use.

Also, in conventional superplastic forming aluminum alloys, no particular attention has been paid to their color after anodization. It was thus difficult to ensure that the anodized alloys consistently exhibited a placid grey or black color.

SUMMARY OF THE INVENTION

Therefore, a primary object of the present invention is to provide a rolled aluminum alloy which not only exhibits improved superplastic forming behavior, but is feasible to anodizing, thus showing improved properties of corrosion resistance and outer appearance after anodization as well as weldability, strength, fatigue resistance and toughness.

Another object of the present invention is to provide a rolled aluminum alloy which additionally provides placid grey to black color in a consistent manner after anodization.

The inventors have found that a rolled aluminum alloy which not only exhibits improved superplastic forming behavior, but meets all desired properties including strength, fatigue resistance and toughness after forming, weldability, feasibility to anodize, and corrosion resistance and outer appearance after anodization can be obtained by restricting the chemical alloy composition to a specific range and controlling the size of intermetallic compounds and the content of hydrogen in the alloy prior to superplastic forming. The aluminum alloy in which the size of Mn base precipitates and the amount of Si in entire precipitates are further restricted not only meets the above-mentioned properties, but ensures that the color after anodization be consistently a placid grey to black color.

The present invention is directed to a rolled aluminum alloy adapted for superplastic forming. According to a first aspect of the present invention, the alloy consists essentially of, in % by weight, (A) 2.0 to 8.0% of Mg, (B) 0.3 to 1.5% of Mn, (C) 0.0001 to 0.01% of Be, (D) less than 0.2% of Fe and less than 0.1% of Si as impurities, and the balance of Al. Other incidental impurities are present. Intermetallic compounds have a size of up to 20 μm. The content of hydrogen present is up to 0.35 cc per 100 grams of the alloy.

According to a second aspect, the alloy contains (E) at least one member selected from the group consisting of 0.05 to 0.3% of Cr, 0.05 to 0.3% of V, and 0.05 to 0.3% of Zr in addition to the essential components.

According to a third aspect, the alloy contains (F) 0.005 to 0.15% of Ti alone or in combination with 0.0001 to 0.05% by weight of B for grain refinement in addition to the essential components.

It is also contemplated to combine the second and third aspects. That is, according to a fourth aspect, the alloy contains (E) at least one member selected from the group consisting of 0.05 to 0.3% of Cr, 0.05 to 0.3% of V, and 0.05 to 0.3% of Zr and (F) 0.005 to 0.15% of Ti alone or in combination with 0.0001 to 0.05% by weight of B for grain refinement in addition to the essential components.

The rolled aluminum alloys according to the third and fourth aspects exhibit grey to black color after anodization by imposing further limitations that Mn base precipitates have a size of at least 0.05 μm, and that the amount of Si in entire precipitates is up to 0.07% by weight based on the total weight of the rolled alloy.

According to the present invention, a rolled aluminum alloy adapted for superplastic forming is prepared by the steps of: forming an alloy of the above-defined composition by melting and semi-continuous casting, heating the cast ingot at a temperature of 400° to 560° C., preferably 430° to 560° C., for ½ to 24 hours, and hot rolling and then cold rolling the material into a strip of a predetermined gage. The cold rolling step includes final cold rolling to a draft of at least 30%. In a preferred embodiment, coarse cell layers are removed from the surfaces of the cast ingot by scalping prior to the heating step.

DETAILED DESCRIPTION OF THE INVENTION

Figure 1:
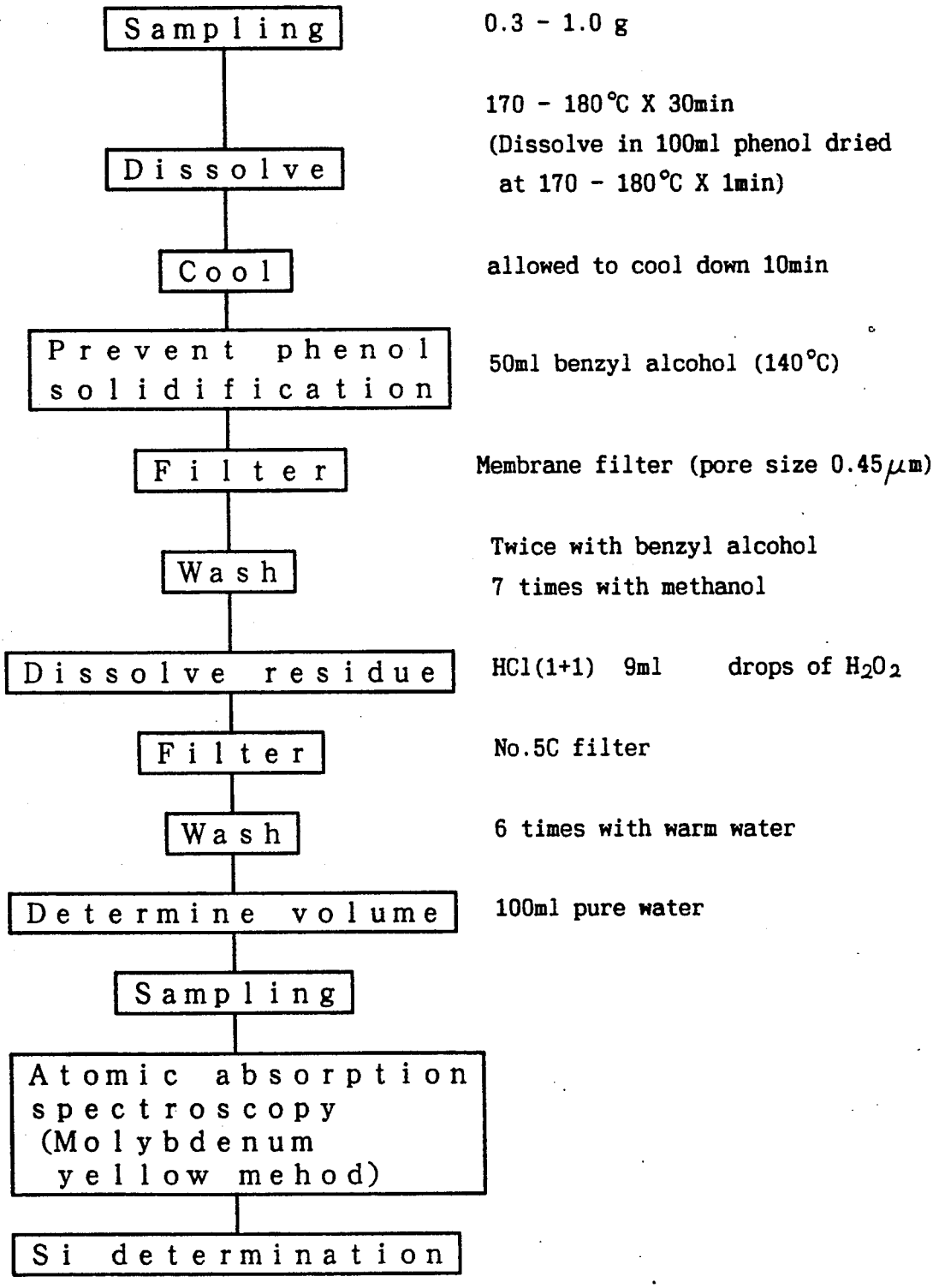
FIG. 1 is a flow chart showing steps of measurement of the Si content in precipitates.

Broadly stated, the aluminum alloys according to the present invention consist essentially of, in % by weight, (A) 2.0 to 8.0% of Mg, (B) 0.3 to 1.5% of Mn, (C) 0.0001 to 0.01% of Be, (D) less than 0.2% of Fe and less than 0.1% of Si as impurities, optionally (E) at least one member selected from the group consisting of 0.05 to 0.3% of Cr, 0.05 to 0.3% of V, and 0.05 to 0.3% of Zr, optionally (F) 0.005 to 0.15% of Ti alone or in combination with 0.0001 to 0.05% by weight of B for grain refinement, and the balance of Al and incidental impurities.

The reason of limiting the content of alloying components is first described.

Mg: 2.0 to 8.0%

Magnesium is effective in improving superplastic forming behavior by promoting dynamic recrystallization during the process. It is also effective in improving the strength and superplasticity of aluminum alloy materials both before and after anodization without adversely affecting the corrosion resistance and weldability thereof. Further Mg promotes precipitation of Mn, contributing to the grey or black color imparted to the anodized aluminum alloy. Less than 2.0% of Mg is insufficient to impart superplasticity and strength after forming whereas alloys containing more than 8.0% of Mg are difficult to produce due to poor hot and cold rolling performance. The Mg content is thus limited to 2.0 to 8.0%. The preferred Mg content is from 2.0 to 6.0%.

Mn: 0.3 to 1.5%

Manganese is essential for imparting a homogeneous and fine grain structure to the aluminum alloy so that the alloy may have improved superplasticity.

The inventors have found that the size of intermetallic compounds is an effective factor for controlling the grain structure and reducing cavitation upon superplastic forming. That is, by properly controlling the size of intermetallic compounds, superplasticity is improved as well as strength and fatigue property after forming. Unless intermetallic compounds have a size of up to 20 μm, it is difficult to control the grain structure at the start of superplastic forming and grains will grow during superplastic forming. Coarse intermetallic compounds in excess of 20 μm will constitute nucleation sites, adversely affecting superplasticity.

For these reasons, the Mn content is limited to the range of 0.3 to 1.5% in order to reduce the size of intermetallic compounds to 20 μm or less. Less than 0.3% of Mn is insufficient to render the grain structure homogeneous and fine. With more than 1.5% of Mn, coarse proeutectic intermetallic compounds will create during semi-continuous casting to promote cavitation, resulting in losses of superplasticity, strength and fatigue property after forming.

Manganese is also essential to color anodized films grey or black. The inventors have found that the size and type of Mn base precipitates are correlated to the ability of anodized films to develop grey or black color. More particularly, known Mn base precipitates include $Al_6Mn$, $Al_6(MnFe)$, α-AlMn(Fe)Si, and those compounds having minor amounts of Cr, Ti and other elements in solid solution state. Among these Mn base precipitates, those $Al_6Mn$ and $Al_6(MnFe)$ precipitates having a size of at least 0.05 μm contribute to the grey or black color development, whereas the αAlMn(Fe)Si precipitates tend to impart yellowness and are thus undesirable for grey or black color development. In order that anodized aluminum alloy plates exhibit grey or black color, it is necessary that Mn base precipitates, especially $Al_{16}Mn$ and $Al_6(MnFe)$ precipitates, having a size of at least 0.05 μm form.

Also in this regard, less than 0.3% of Mn is insufficient to provide grey to black color after anodization. More than 1.5% of Mn is undesirable for the above-mentioned reason that coarse proeutectic intermetallic compounds will create during semi-continuous casting. Therefore, the Mn content should also be limited to the range of 0.3 to 1.5% when the color after anodization is required to be grey or black.

Be: 0.0001 to 0.01%

Beryllium is generally added for preventing oxidation of Mg upon melting. In the alloy composition of the present invention, Be forms a dense oxide film on the surface of a melt, and is thus also effective in preventing hydrogen entry and hence protecting rolled strips against cavitation. Also, Be serves to restrain oxidation of Mg on the rolled plate surface to stabilize the surface. Since superplastic forming is often carried out at elevated temperatures of from 350° to 560° C., aluminum alloys having a relatively high Mg content as in the present invention can undergo severe oxidation on the surface during superplastic forming so that the surface turns black and will become irregularly patterned during subsequent anodization. The addition of Be restrains surface oxidation during superplastic forming, thus facilitating the pretreatment of the underlying surface prior to coating or rendering the surface after anodization uniform.

Less than 0.0001% of Be is ineffective whereas no further benefit is obtained and problems of toxicity and economy arise beyond 0.01% of Be.

Ti: 0.005 to 0.15%

A minor amount of titanium is added alone or along with boron for the purpose of cast ingot grain refinement. If cast ingot grains are not sufficiently fine, abnormal structures such as floating crystals and feather-like crystals will crystallize out, resulting in streaks and irregular patterns on the outer appearance of formed parts after anodization. Less than 0.005% of Ti is ineffective whereas coarse proeutectic TiA13 particles will crystallize out in excess of 0.15% of Ti.

B: 0.0001 to 0.05%

Boron is added in combination with titanium to further promote grain refinement and homogenization. They are commonly added in the form of an Al-Ti-B alloy. When added, less than 0.0001% of B is ineffective whereas $TiB_2$ particles will crystallize out in excess of 0.05% of B.

Cr, V, Zr: 0.05 to 0.3%

If desired, at least one element selected from Cr, V and Zr is added in addition to the essential alloying elements mentioned above. These elements are effective in refining and stabilizing recrystallized grains and preventing formation of abnormally coarse grains during superplastic forming. Cr promotes blackening after anodization and somewhat varies the tone of black color developed. More particularly, the color is somewhat bluish grey or black when Mn is added alone, but the addition of Cr eliminates a bluish component and imparts some yellowness. For any of Cr, V and Cr, less than 0.05% is insufficient for their purpose whereas more than 0.3% will form undesirably coarse intermetallic compounds.

General aluminum alloys contain Fe and Si as impurities. Since these impurities have a critical influence on the alloy of the invention, their content should be limited as follows.

Fe: less than 0.2%

Iron, if present in substantial contents, will form intermetallic compounds such as Al-Fe, Al-Fe-Mn, and Al-Fe-Si compounds during casting, which will cause cavitation during subsequent superplastic forming and a lowering of superplastic elongation. The presence of cavities, of course, results in losses of mechanical properties, fatigue resistance and corrosion resistance of formed parts. Therefore, lesser iron contents are desirable. Iron also affects precipitation of Mn, with higher Fe contents resulting in coarse intermetallic compounds crystallizing out. To avoid these adverse influences of Fe, its content should be limited to less than 0.2%.

Si: less than 0.1%

Silicon, if present, tends to allow coarse intermetallic compounds such as α-Al-Mn(Fe) Si and $Mg_2Si$ phases to crystallize out, adversely affecting superplasticity. The α-Al-Mn(Fe)-Si phase, which precipitates out due to the presence of Si, would add yellowness to the color of anodized aluminum alloy, disturbing blackening. Since this influence is very strong, the content of Si among other impurities should be strictly limited in order to obtain grey to black color. A total silicon content of more than 0.1% would undesirably increase yellowness. It is then necessary to limit the maximum silicon content to 0.1% in order to provide grey to black color. Silicon contents of less than 0.1% are accompanied by the benefit of improved superplasticity.

If the amount of Si in entire precipitates is in excess of 0.07% by weight of the total weight of the rolled alloy plate, the plate appears somewhat more yellowish after anodization. Therefore, not only the total silicon content, but the amount of silicon in entire precipitates should also be limited where grey or black color is desired after anodization.

The components of the alloy other than the above-mentioned essential and optional elements are basically aluminum and incidental impurities (other than Fe and Si). It is to be noted that the presence of up to 0.5% of Cu and/or Zn contributes to strength improvement without adversely altering the results of the invention. Therefore, inclusion of up to 0.5% of Cu and up to 0.5% of Zn is acceptable.

In the rolled aluminum alloys of the present invention adapted to superplastic forming, their chemical composition is limited as defined above and at the same time, the size of intermetallic compounds and the hydrogen content are limited. That is, intermetallic compounds should have a size of up to 20 μm, and the content of hydrogen present be up to 0.35 cc per 100 grams of the alloy. The reason why the size of intermetallic compounds is limited has been described in conjunction with the manganese content.

During superplastic forming, the hydrogen content of materials dictates the occurrence of cavitation. More particularly, hydrogen gas concentrates at recrystallizing grain boundaries in the material during superplastic forming at elevated temperatures, promoting cavitation. If the material subject to superplastic forming has a hydrogen content in excess of 0.35 cc/100 grams, the quantity of cavities induced is increased to such an extent that superplasticity is reduced and strength and fatigue property after forming are substantially lowered. Therefore, rolled aluminum alloy plates should have a hydrogen content of 0.35 cc/100 grams or lower prior to superplastic forming.

The hydrogen content can be controlled to the desired range by various means. The most effective means is molten metal treatment. While various molten metal treatments are known, it is most common to blow chlorine gas (or a mixture of chlorine gas with nitrogen or argon) into the molten metal for more than 15 minutes. Argon gas bubbling known as SNIF method is also acceptable. To improve superplasticity, the quantity of dissolved hydrogen gas is desirably controlled to 0.35 cc/100 grams by any molten metal treatment. It is also effective for the hydrogen content control to effect batchwise intermediate or final annealing while limiting the dew point in the annealing furnace to 10° C. or lower.

It is, of course, recommended that the atmosphere for superplastic forming have as low a water vapor amount as possible. Since the superplastic forming pressure is often provided by the supply of compressed air or nitrogen, it is desired to limit the dew point of the supply gas to 10° C. or lower by passing the gas through drying means.

In the preferred embodiment of the rolled aluminum alloy of the present invention for superplastic forming where the rolled plate after anodization is desired to have grey to black color, it is necessary that manganese base precipitates have a size of at least 0.05 μm. The reason has been described in conjunction with the manganese content.

Next, the preparation of the rolled aluminum alloy for superplastic forming according to the present invention is described.

First, the necessary elements as previously defined are melted to form a molten alloy which is cast, most often by a semi-continuous casting process known as a direct chill (DC) casting process.

For the applications destined toward building panels and trunks, rolled strips are commonly anodized prior to use. It is necessary to avoid occurrence of streaks and irregular patterns on the surface of anodized strips. To this end, the cast ingot should have a homogeneous structure. Thus, a grain refining agent in the form of Al-Ti or Al-Ti-B is added to the molten metal in an amount of 0.15% or less calculated as Ti. The grain refining agent may be added either in a waffle form prior to casting or continuously in a rod form during casting.

In order to limit the hydrogen content of rolled strips to 0.35 cc/100 grams or lower, any desired molten metal treatment is applied as previously described, including the chlorine gas blowing method in which chlorine gas or a mixture of chlorine gas with nitrogen or argon gas is blown into the molten metal and the SNIF method in which argon gas is bubbled.

The cast ingot is scalped prior to hot rolling, if necessary, but essentially when it is desired to obtain grey to black color after anodization. In the semi-continuous casting of ingots, a coarse structured phase inevitably forms on the ingot surface in spite of an attempt to obtain a fine homogeneous structure. If this phase is present in a surface layer of rolled strips, anodization will result in irregular patterns. Therefore, the coarse cell phase should be removed by scalping at the ingot stage.

Then, the ingot is heated at 400° to 560° C. for ½ to 24 hours for heating and soaking. This ingot heating may be carried out either in a single stage for both heating and soaking or separately in two stages. In the latter case, it suffices that the higher temperature stage meets the abovementioned conditions. Ingot heating at a temperature of lower than 400° C. achieves soaking or homogenization to a less extent so that during subsequent superplastic forming, the grain structure control becomes difficult and rather grains will grow to detract from superplasticity. Also, precipitates will not reach a size of 0.05 μm or larger. Then the color after anodization becomes more yellowish or reddish rather than grey or black. In order to ensure that precipitates have a size of 0.05 μm or larger and the color after anodization be grey or black color, ingot heating temperatures of higher than 430° C. are desired. If the ingot heating temperature exceeds 560° C., then eutectic melting is likely to occur and intermetallic compounds become coarse to alter superplasticity. An ingot heating time of less than ½ hour is too short to achieve uniform heating whereas more than 24 hours is unnecessary because of no further benefit and increased cost.

Next, the ingot is hot rolled and cold rolled to a desired thickness in a conventional manner. Intermediate annealing may be carried out between hot and cold rolling steps and/or midway the cold rolling step. If the draft of the final cold rolling is two low, recrystallized grains would sometimes become too coarse to provide super. plasticity. Desirably, the final cold rolling is carried out to a draft of 30% or more. There are obtained rolled strips of the aluminum alloy.

The final step is annealing, but optional. In practice, superplastic forming uses a temperature of 350° to 560° C. Since recrystallization can take place during heating to the superplastic forming temperature so that superplasticity is developed, the strip manufacturing process need not necessarily include final annealing. In general, however, final annealing is often effected to insure a recrystallized structure. Either continuous or batchwise annealing may be employed, with the continuous annealing being somewhat advantageous for superplasticity. The batchwise annealing is at 250° to 400° C. for ½ hour or longer, and the continuous annealing is at 35° to 550° C. without holding or for at most 180 seconds.

As previously described, in order to control the hydrogen content of rolled strips, intermediate or final annealing, especially batchwise intermediate or final annealing is desirably carried out in the furnace adjusted to a dew point of 10° C. or lower. If gas is supplied during superplastic forming, the gas supply should also preferably have a dew point of 10° C. or lower.

EXAMPLE

Examples of the present invention are given below by way of illustration and not by way of limitation.

Alloys designated Alloy Nos. 1 to 10 in Table 1 were melted and semi-continuously (DC) cast into slabs of 350 mm ×1,000 mm in cross section. For each of the melts of Alloy Nos. 1 to 8, a molten metal treatment was carried out by blowing chlorine gas into the melt for 30 minutes. For the melt of Alloy No. 9, a molten metal treatment was carried out by the SNIF method, that is, by bubbling argon gas into the melt. For grain refinement, a rod of Al.5%Ti.1%B mother alloy was added to the alloy melts except Alloy Nos. 1 and 3 during casting.

After casting, slices were sampled from the slabs to observe their structure, finding no abnormal structure identified as feather-like grains or floating grains except Alloy Nos. 1 and 3. The cast slabs on the surface had a coarse cell layer of about 5 to 10 mm thick. The slabs of Alloy Nos. 1 and 3 consisted of feather-like grains over the entire area of a cross section.

The slabs were scalped by 12 mm on each surface to remove the coarse cell layers and then heated and soaked under the conditions shown in Table 2.

The slabs were hot rolled to a thickness of 6 mm, cold rolled to a thickness of 2 mm, and then subjected to final annealing through a continuous annealing furnace at 480° C. without holding. It is to be noted that the soaking furnace and the preheating furnace for hot rolling were adjusted to a dew point of 4° C.

For comparison purposes, conventional well-known superplastic forming materials, AA7475 alloy (designated Alloy No. 11) and Supral alloy (Al-6%Cu-0.4%Zr alloy, designated Alloy No. 12) were used. The 7475 alloy used was a commercially available superplastic forming 7475 alloy strip of 2 mm thick manufactured by the TMT process. A strip of the Supral alloy was experimentally manufactured by mold casting to dimensions of 30 mm×150 mm×200 mm, heating at 500° C. for 2 hours, hot rolling to a thickness of 6 mm, and then cold rolling to a thickness of 2 mm.

TABLE 1

| Alloy No. | Composition (wt %) Mg | Mn | Fe | Si | Cr | Zr | V | Ti | B | Be | Al | Intermetallic Compound diameter (μm) | Hydrogen Content* (cc/100 g) | Molten metal treatment | Remarks |
|---|---|---|---|---|---|---|---|---|---|---|---|---|---|---|---|
| 1 | 3.2 | 0.82 | 0.12 | 0.08 | — | — | — | — | — | — | Bal. | <13 | 0.16 | Cl gas | Invention |
| 2 | 4.2 | 0.62 | 0.07 | 0.07 | — | — | — | 0.03 | 0.0007 | 0.0011 | Bal. | <7 | 0.18 | Cl gas | Invention |
| 3 | 4.4 | 0.71 | 0.07 | 0.04 | 0.10 | — | — | — | — | 0.0009 | Bal. | <7 | 0.19 | Cl gas | Invention |
| 4 | 4.5 | 0.72 | 0.06 | 0.04 | 0.11 | — | — | 0.01 | 0.0003 | 0.0006 | Bal. | <6 | 0.20 | Cl gas | Invention |
| 5 | 3.9 | 1.21 | 0.04 | 0.06 | — | 0.06 | — | 0.02 | 0.0008 | 0.0009 | Bal. | <8 | 0.20 | Cl gas | Invention |
| 6 | 5.2 | 1.01 | 0.07 | 0.06 | — | — | 0.06 | 0.01 | 0.0004 | 0.0021 | Bal. | <10 | 0.19 | Cl gas | Invention |

TABLE 1-continued

| Alloy No. | Composition (wt %) Mg | Mn | Fe | Si | Cr | Zr | V | Ti | B | Be | Al | Intermetallic Compound diameter (μm) | Hydrogen Content* (cc/100 g) | Molten metal treatment | Remarks |
|---|---|---|---|---|---|---|---|---|---|---|---|---|---|---|---|
| 7 | 4.3 | — | 0.12 | 0.21 | — | — | — | 0.01 | 0.0005 | — | Bal. | <18 | 0.17 | Cl gas | Comparison |
| 8 | 1.3 | 0.52 | 0.24 | 0.07 | — | — | — | 0.03 | 0.0004 | 0.0012 | Bal. | <24 | 0.18 | Cl gas | Comparison |
| 9 | 4.3 | 0.70 | 0.09 | 0.08 | — | — | — | 0.02 | 0.0006 | 0.0009 | Bal. | <10 | 0.08 | SNIF | Invention |
| 10 | 4.3 | 0.63 | 0.06 | 0.04 | 0.01 | — | — | 0.02 | 0.0007 | 0.0009 | Bal. | <6 | 0.42 | No | Comparison |
| | 11 | | | | 7474 alloy (Al - 5.5% Zn - 2.5% Mg - 1.5% Cu - 0.2% Cr) | | | | | | | | | | Conventional |
| | 12 | | | | SUPRAL (Al - 6% Cu - 0.4% Zr) | | | | | | | | | | Conventional |

*Hydrogen gas content in the slab immediately after scalping

TABLE 2

| Lot | Alloy No. | Soaking | Hot roll preheating temperature |
|---|---|---|---|
| A | 1 | 530° C. × 6 hr. | 450° C. |
| B | 2 | 530° C. × 6 hr. | 450° C. |
| C | 2 | — | 380° C. |
| D | 3 | 500° C. × 6 hr. | 450° C. |
| E | 4 | 500° C. × 6 hr. | 450° C. |
| F | 5 | 450° C × 10 hr. | 450° C. |
| G | 6 | 530° C. × 12 hr. | 450° C. |
| H | 7 | 530° C. × 6 hr. | 450° C. |
| I | 8 | 530° C. × 6 hr. | 450° C. |
| J | 9 | 530° C. × 6 hr. | 450° C. |
| K | 10 | 530° C. × 6 hr. | 450° C. |

Specimens of 4 mm wide having a parallel side length of 15 mm were cut out of the strips for determining super-plasticity. For these specimens, the hydrogen gas content prior to superplastic forming is reported in Table 3 together with the conditions and results of superplasticity measurement. Superplastic behavior was evaluated "passed" when the elongation exceeded 15%, but "rejected" when the elongation was lower.

TABLE 3

| Lot | Alloy No. | Hydrogen content (cc/100 g) | Superplastic forming Temp. (°C.) | Forming rate | Elongation (%) | Behavior |
|---|---|---|---|---|---|---|
| A | 1 | 0.15 | 550 | $1 \times 10^{-3}$ | 311 | Pass |
| B | 2 | 0.21 | 550 | $1 \times 10^{-3}$ | 342 | Pass |
| C | 2 | 0.19 | 550 | $1 \times 10^{-2}$ | 75 | Rejected |
| D | 3 | 0.19 | 520 | $1 \times 10^{-3}$ | 360 | Pass |
| E | 4 | 0.20 | 520 | $1 \times 10^{-3}$ | 382 | Pass |
| F | 5 | 0.22 | 430 | $1 \times 10^{-2}$ | 208 | Pass |
| G | 6 | 0.19 | 550 | $1 \times 10^{-1}$ | 323 | Pass |
| H | 7 | 0.18 | 550 | $1 \times 10^{-3}$ | 84 | Rejected |
| I | 8 | 0.19 | 550 | $1 \times 10^{-3}$ | 68 | Rejected |
| J | 9 | 0.10 | 550 | $1 \times 10^{-3}$ | 405 | Pass |
| K | 10 | 0.37 | 550 | $1 \times 10^{-3}$ | 136 | Rejected |
| L | 11 | — | 520 | $1 \times 10^{-4}$ | 896 | Pass |
| M | 12 | — | 460 | $1 \times 10^{-3}$ | 984 | Pass |

As seen from Table 3, the strips having an alloy composition and a hydrogen content within the scope of the present invention (Alloy Nos. 1.6 and 9) showed an increased elongation of higher than 150% except the lot where the slab heating temperature was too low (Lot C of Alloy No. 2). Their superplastic behavior was improved over the comparative specimens, though not as good as the conventional superplastic forming materials.

Next, Alloy Nos. 2, 9 and 10 having an alloy composition within the scope of the present invention were subjected, after hot rolling, to batchwise intermediate annealing (350° C.×120 min.) at varying dew points for determining the hydrogen gas content prior to superplastic forming, superplasticity (elongation) at 550° C., and strength and fatigue limit (at 1×10cycles) after 100% superplastic forming. The results are shown in Table 4. The conditions of the steps other than intermediate annealing were the same as previously mentioned.

TABLE 4

| Lot | Alloy No. | Dew point (°C.) | Hydrogen content (cc/100 g) | Superplastic Elongation (%) | After superplastic forming Strength ($N/mm^2$) | Fatigue limit ($N/mm^2$) |
|---|---|---|---|---|---|---|
| B' | 2 | 4 | 0.21 | 342 | 146 | 140 |
| B'' | 2 | 25 | 0.36 | 140 | 132 | 130 |
| J' | 9 | 4 | 0.10 | 405 | 151 | 145 |
| J'' | 9 | 25 | 0.24 | 312 | 146 | 140 |
| K' | 10 | 4 | 0.37 | 137 | 125 | 115 |
| K'' | 10 | 25 | 0.47 | 124 | 114 | 100 |

*A rolled strip of Alloy No. 1 prior to superplastic forming had a strength of 155 $N/mm^2$ and a fatiuge limit of 150 $N/mm^2$ at $1 \times 10^7$ cycles.

As seen from Table 4, the dew point in the intermediate annealing furnace has an influence on the hydrogen gas content. It is evident that by controlling the dew point so as to provide a hydrogen gas content of less than 0.35 cc/100 grams, the superplasticity is improved as demonstrated by a superplastic elongation in excess of 150% and the strength and fatigue property are also improved.

WELDABILITY

Figure 2:
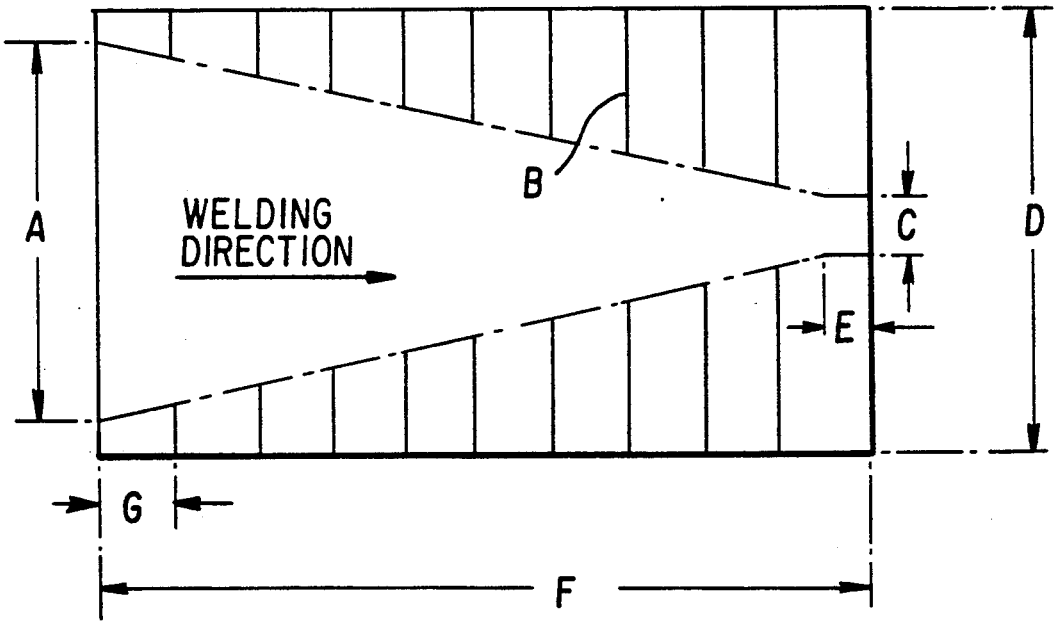
FIG. 2 is a plan view schematically showing a fishbone slit specimen for use in a weld cracking test.

A weld cracking test was carried out on Alloy Nos. 2 and 4 within the scope of the present invention, conventional 7475 alloy (Alloy No. 11), and Supral alloy (Alloy No. 12). The test used a fishbone slit specimen as shown in FIG. 2, having the following lengths corresponding to the dimension reference characters in FIG. 2; A=38 mm; B=1.0 mm wide slit; C=6.4 mm; D=45 mm; E=6 mm; F=76 mm and G=7.6 mm. The fishbone split specimen was subject to TIG welding by means of an automatic TIG welder (without overlay) under conditions including current flow 60 amperes, travel speed 25 cm/min., a tungsten electrode of 2.4 mm in diameter, argon stream, and arc length 3 mm. The cracking rate was determined which was equal to the length of cracked beads divided by the entire welding bead length (expressed in %). The results are shown in Table 5.

TABLE 5

| Lot | Alloy No. | cracking rate (%) |
|---|---|---|
| B | 2 | 13 |
| E | 4 | 11 |
| L | 11 | 68 |
| M | 12 | 48 |

As seen from Table 5, the alloys of the present invention are improved in weldability over the conventional alloys.

CORROSION RESISTANCE

Alloy Nos. 2 and 4 to 6 within the scope of the present invention, conventional 7475 alloy (Alloy No. 11), and Supral alloy (Alloy No. 12) were examined for corrosion resistance. A specimen of 70 mm×150 mm was cut out of the strip, dipped in 10% NaOH aqueous solution at 50° C. for 1 minute, washed with pure water, desmutted with $HNO_3$, washed again with pure water, and then subjected to a salt spray test (SST) according to JIS Z.2371 for 1000 hours for evaluating the corrosion resistance. The evaluation was made according to the following criterion.

Excellent: no pit
Good: some pits
Fair: many pits
Poor: pits over the entire surface The results are shown in Table 6.

TABLE 6

| Lot | Alloy No. | SST rating |
|---|---|---|
| B | 2 | Excellent |
| E | 4 | Excellent |
| F | 5 | Excellent |
| G | 6 | Excellent |
| L | 11 | Fair-Poor |
| M | 12 | Poor |

As seen from Table 6, the alloys of the present invention are significantly more corrosion resistant than the conventional alloys.

ANODIZING

A test was conducted for examining the anodizing feasibility and the color after anodization. Samples of Alloy Nos. 1 to 8, 7475 alloy (Alloy No. 11), and Supral alloy (Alloy No. 12) were held at the superplastic stretching temperature for 30 minutes and then furnace cooled. For the conventional alloys (7475 alloy and Supral alloy), samples of another set were held at the superplastic stretching temperature for 30 minutes and then quenched in water from the temperature. To examine the anodizing feasibility and the color and appearance after anodization, the samples were etched with 10% NaOH, washed with water, desmutted with nitric acid, and then anodized in a 15% sulfuric acid electrolyte at a temperature of 20° C. and a current density of 1.5 A/dm$^2$ to form an anodized film of 20 μm thick. The anodized samples were analyzed by colorimetry. Using a colorimeter Model SM.3.MCH (manufactured by Suga Shikenki K. K.), evaluation was made in terms of L, a and b values of Hunter's colorimetric system. A higher L value indicates whiter color, a higher a value indicates reddish color, and a higher b value indicates yellowish color. The color is defined to be "grey or black" as used herein when all the conditions:

$L<65$, $-2<a<2$, and $-2<b<2$ are met. A sample in which none of these conditions are met is rated "No" under the heading "Color" in Table 7.

Further for the anodized samples, the size of precipitates was measured. The content of Si in the precipitates was measured according to the flow chart of FIG. 1.

The results are shown in Table 7.

Another anodizing test was conducted on some samples, lots E and F of alloy Nos. 4 and 5 by chemically etching the samples with a commercially available phosphoric acid-nitric acid etching solution at 95° C. for 30 seconds, washing with water, and anodizing under the same conditions as above. The results are shown in Table 8.

TABLE 7

| Lot | Alloy No. | Appearance | Colorimetry L | a | b | Color | Si content in precipitates (wt %) | Precipitate size (μm) |
|---|---|---|---|---|---|---|---|---|
| A | 1 | Streaks* | 61 | 0.82 | 0.76 | Grey | 0.02 | 0.12-1.2 |
| B | 2 | Good | 54 | 0.12 | 0.21 | Dark grey | 0.02 | 0.08-1.2 |
| C | 2 | Good | 68 | 2.4 | 2.6 | No | 0.02 | 0.01-0.06 |
| D | 3 | Streaks* | 61 | 0.35 | 1.10 | Grey | 0.01 | 0.15-1.5 |
| E | 4 | Good | 62 | 0.32 | 1.12 | Grey | 0.01 | 0.12-1.2 |
| F | 5 | Good | 34 | 0.23 | 0.06 | Black | 0.01 | 0.05-1.1 |
| G | 6 | Good | 52 | 0.15 | −0.23 | Dark grey | 0.01 | 0.08-1.2 |
| H | 7 | Good | 78 | 0.7 | 2.8 | No | 0.16 | >0.8 |
| I | 8 | Good | 72 | 1.2 | 3.2 | No | 0.05 | >0.5 |
| L | 11 | Powdering | 48 | 0.21 | 0.38 | Dark grey | — | — |
| L' | 11 | Good | 73 | 5.2 | 13.8 | No | — | — |
| M | 12 | Powdering | 54 | 3.2 | 4.3 | No | — | — |
| M' | 12 | Streaks* | 66 | 4.8 | 7.9 | No | — | — |

*streaks and local surface oxidation
L' and M': water quenched samples

TABLE 8

| Lot | Alloy No. | Appearance | Colorimetry L | a | b | Color | Si content in precipitates (wt %) | Precipitate size (μm) |
|---|---|---|---|---|---|---|---|---|
| E | 4 | Good | 60 | 0.18 | 1.01 | Grey | 0.01 | 0.12-1.2 |

TABLE 8-continued

| Lot | Alloy No. | Appearance | Colorimetry L | a | b | Color | Si content in precipitates (wt %) | Precipitate size (μm) |
|---|---|---|---|---|---|---|---|---|
| F | 5 | Good | 31 | 0.11 | −0.03 | Black | 0.01 | 0.05-1.2 |

As seen from Table 7, after anodization, those samples having a grain refining agent added in which the size of precipitates and the silicon content in precipitates meet the requirements of the preferred embodiment show grey to black color, are free of defects such as streaks, local surface oxidation, and powdering, and present a good uniform outer appearance.

There have been described rolled aluminum alloy strips which exhibit not only improved superplasticity, but also improved corrosion resistance with or without anodization, weldability, and paint receptivity. They maintain strength, fatigue resistance and toughness after superplastic forming, eliminating a need for any additional heat treatment. Therefore, they fully meet a variety of requirements for interior and exterior building panels and containers (e.g, trunks) as well as various structural members. In addition to these advantages, the rolled aluminum alloy strips in the preferred embodiment, after anodization, always show grey or black color and an esthetic appearance free of streaks and irregular patterns. They are best suited when an outer appearance of placid blackish color is desired.

Although some preferred embodiments have been described, many modifications and variations may be made thereto in the light of the above teachings. It is therefore to be understood that within the scope of the appended claims, the invention may be practiced otherwise than as specifically described.

We claim:

1. A rolled aluminum alloy adapted for superplastic forming, consisting essentially of, in % by weight,
2.0 to 8.0% of Mg,
0.3 to 1.5% of Mn,
0.0001 to 0.01% of Be,
less than 0.2% of Fe and less than 0.1% of Si as impurities, and
the balance of Al,
wherein intermetallic compounds have a size of up to 20 μm, and the content of hydrogen present is up to 0.35 cc per 100 grams of the alloy.

2. A rolled aluminum alloy adapted for superplastic forming, consisting essentially of, in % by weight,
2.0 to 8.0% of Mg,
0.3 to 1.5% of Mn,
0.0001 to 0.01% of Be,
at least one member selected from the group consisting of 0.05 to 0.3% of Cr, 0.05 to 0.3% of V, and 0.05 to 0.3% of Zr,
less than 0.2% of Fe and less than 0.1% of Si as impurities, and
the balance of Al,
wherein intermetallic compounds have a size of up to 20 μm, and the content of hydrogen present is up to 0.35 cc per 100 grams of the alloy.

3. A rolled aluminum alloy adapted for superplastic forming, consisting essentially of, in % by weight,
2.0 to 8.0% of Mg,
0.3 to 1.5% of Mn,
0.0001 to 0.01% of Be,
0.005 to 0.15% of Ti alone or in combination with 0.0001 to 0.05% by weight of B for grain refinement,
less than 0.2% of Fe and less than 0.1% of Si as impurities, and
the balance of Al,
wherein intermetallic compounds have a size of up to 20 μm, and the content of hydrogen present is up to 0.35 cc per 100 grams of the alloy.

4. A rolled aluminum alloy adapted for superplastic forming, consisting essentially of, in % by weight,
2.0 to 8.0% of Mg,
0.3 to 1.5% of Mn,
0.0001 to 0.01% of Be,
at least one member selected from the group consisting of 0.05 to 0.3% of Cr, 0.05 to 0.3% of V, and 0.05 to 0.3% of Zr,
0.005 to 0.15% of Ti alone or in combination with 0.0001 to 0.05% by weight of B for grain refinement,
less than 0.2% of Fe and less than 0.1% of Si as impurities, and
the balance of Al,
wherein intermetallic compounds have a size of up to 20 μm, and the content of hydrogen present is up to 0.35 cc per 100 grams of the alloy.

5. A rolled aluminum alloy adapted for superplastic forming and exhibiting grey to black color after anodization, consisting essentially of, in % by weight,
2.0 to 8.0% of Mg,
0.3 to 1.5% of Mn,
0.0001 to 0.01% of Be,
0.005 to 0.15% of Ti alone or in combination with 0.0001 to 0.05% by weight of B for grain refinement,
less than 0.2% of Fe and less than 0.1% of Si as impurities, and
the balance of Al,
wherein intermetallic compounds have a size of up to 20 μm, manganese base precipitates have a size of at least 0.05 μm, the amount of Si in entire precipitates is up to 0.07% by weight based on the total weight of the rolled alloy, and the content of hydrogen present is up to 0.35 cc per 100 grams of the alloy.

6. A rolled aluminum alloy adapted for superplastic forming and exhibiting grey to black color after anodization, consisting essentially of, in % by weight,
2.0 to 8.0% of Mg,
0.3 to 1.5% of Mn,
0.0001 to 0.01% of Be,
at least one member selected from the group consisting of 0.05 to 0.3% of Cr, 0.05 to 0.3% of V, and 0.05 to 0.3% of Zr,
0.005 to 0.15% of Ti alone or in combination with 0.0001 to 0.05% by weight of B for grain refinement,
less than 0.2% of Fe and less than 0.1% of Si as impurities, and
the balance of Al, wherein intermetallic compounds have a size of up to 20 μm, manganese base precipitates have a size of at least 0.05 μm, the amount of Si in entire precipitates is up to 0.07% by weight based on the total weight of the rolled alloy, and the content of hydrogen present is up to 0.35 cc per 100 grams of the alloy.

7. A method for preparing a rolled aluminum alloy adapted for superplastic forming, comprising the steps of:

forming an alloy consisting essentially of, in % by weight, 2.0 to 8.0% of Mg, 0.3 to 1.5% of Mn, 0.0001 to 0.01% of Be, less than 0.2% of Fe and less than 0.1% of Si as impurities, and the balance of Al, by melting and semicontinuous casting, heating the cast ingot at a temperature of 400° to 560 ©C. for ½ to 24 hours, hot rolling and then cold rolling the material into a strip of a predetermined thickness, the cold rolling step including final cold rolling to a draft of at least 30%.

8. A method for preparing a rolled aluminum alloy adapted for superplastic forming, comprising the steps of:

forming an alloy consisting essentially of, in % by weight, 2.0 to 8.0% of Mg, 0.3 to 1.5% of Mn, 0.0001 to 0.01% of Be, at least one member selected from the group consisting of 0.05 to 0.3% of Cr, 0.05 to 0.3% of V, and 0.05 to 0.3% of Zr, less than 0.2% of Fe and less than 0.1% of Si as impurities, and the balance of Al, by melting and semi-continuous casting, heating the cast ingot at a temperature of 400° to 560° C. for ½ to 24 hours, hot rolling and then cold rolling the material into a strip of a predetermined thickness, the cold rolling step including final cold rolling to a draft of at least 30%.

9. A method for preparing a rolled aluminum alloy adapted for superplastic forming, comprising the steps of:

forming an alloy consisting essentially of, in % by weight, 2.0 to 8.0% of Mg, 0.3 to 1.5% of Mn, 0.0001 to 0.01% of Be, 0.005 to 0.15% of Ti alone or in combination with 0.0001 to 0.05% by weight of B for grain refinement, less than 0.2% of Fe and less than 0.1% of Si as impurities, and the balance of Al, by melting and semi-continuous casting, heating the cast ingot at a temperature of 400° to 560° C. for ½ to 24 hours, hot rolling and then cold rolling the material into a strip of a predetermined thickness, the cold rolling step including final cold rolling to a draft of at least 30%.

10. A method for preparing a rolled aluminum alloy adapted for superplastic forming, comprising the steps of:

forming an alloy consisting essentially of, in % by weight, 2.0 to 8.0% of Mg, 0.3 to 1.5% of Mn, 0.0001 to 0.01% of Be, at least one member selected from the group consisting of 0.05 to 0.3% of Cr, 0.05 to 0.3% of V, and 0.05 to 0.3% of Zr, 0.005 to 0.15% of Ti alone or in combination with 0.0001 to 0.05% by weight of B for grain refinement, less than 0.2% of Fe and less than 0.1% of Si as impurities, and the balance of Al, by melting and semicontinuous casting, heating the cast ingot at a temperature of 400° to 560° C. for ½ to 24 hours, hot rolling and then cold rolling the material into a strip of a predetermined thickness, the cold rolling step including final cold rolling to a draft of at least 30%.

11. A method for preparing a rolled aluminum alloy adapted for superplastic forming and exhibiting grey to black color after anodization, comprising the steps of:

forming an alloy consisting essentially of, in % by weight, 2.0 to 8.0% of Mg, 0.3 to 1.5% of Mn, 0.0001 to 0.01% of Be, 0.005 to 0.15% of Ti alone or in combination with 0.0001 to 0.05% by weight of B for grain refinement, less than 0.2% of Fe and less than 0.1% of Si as impurities, and the balance of Al, by melting and semi-continuous casting, removing coarse cell layers from the surfaces of the cast ingot by scalping, heating the ingot at a temperature of 430°0 to 560° C. for ½ to 24 hours, hot rolling and then cold rolling the material into a strip of a predetermined thickness, the cold rolling step including final cold rolling to a draft of at least 30%.

12. A method for preparing a rolled aluminum alloy adapted for superplastic forming exhibiting grey to black color after anodization, comprising the steps of:

forming an alloy consisting essentially of, in % by weight, 2.0 to 8.0% of Mg, 0.3 to 1.5% of Mn, 0.0001 to 0.01% of Be, at least one member selected from the group consisting of 0.05 to 0.3% of Cr, 0.05 to 0.3% of V, and 0.05 to 0.3% of Zr, 0.005 to 0.15% of Ti alone or in combination with 0.0001 to 0.05% by weight of B for grain refinement, less than 0.2% of Fe and less than 0.1% of Si as impurities, and the balance of Al, by melting and semicontinuous casting, removing coarse cell layers from the surfaces of the cast ingot by scalping, heating the cast ingot at a temperature of 430°0 to 560° C. for ½ to 24 hours, hot rolling and then cold rolling the material into a strip of a predetermined thickness, the cold rolling step including final cold rolling to a draft of at least 30%.

* * * * *